United States Patent [19]

Nakatani et al.

[11] Patent Number: 5,069,266

[45] Date of Patent: Dec. 3, 1991

[54] CYLINDER BLOCK MAKING METHOD AND DEVICE

[75] Inventors: Shigeki Nakatani; Takahiro Idemoto, both of Hiroshima, Japan

[73] Assignee: Mazda Motor Corporation, Hiroshima, Japan

[21] Appl. No.: 701,578

[22] Filed: May 14, 1991

Related U.S. Application Data

[63] Continuation of Ser. No. 467,194, Jan. 18, 1990, abandoned.

[30] Foreign Application Priority Data

Jan. 19, 1989 [JP] Japan ..... 1-10384

[51] Int. Cl.[5] ..... B22D 19/08

[52] U.S. Cl. ..... 164/112; 164/98; 164/70.1; 164/333

[58] Field of Search ..... 164/98, 112, 305, 333, 164/76.1, 70.1

[56] References Cited

U.S. PATENT DOCUMENTS 4,154,285 5/1979 Yamasaki ..... 164/305

FOREIGN PATENT DOCUMENTS 59-94565 5/1984 Japan ..... 164/98

63-180354 7/1988 Japan ..... 164/305

*Primary Examiner*—Kuang Y. Lin

*Attorney, Agent, or Firm*—Fleit, Jacobson, Cohn, Price, Holman & Stern

[57] ABSTRACT

A method and device for making a cylinder block includes a plurality of cylinder liners with flange portions respectively arranged side by side and extending in one direction. Each of the cylinder liners being casted together with a light metal to form a cylinder bore of an engine. The method includes the steps of disposing the cylinder liners within a cavity in a side by side relationship with one another with each of the cylinder liners being held by a core for forming the cylinder bore, forming a material holding section above the flange portions of the two cylinder liners adjacent to each other so as to communicate the two cylinder liners with each other therethrough, introducing a molten material of the light metal into the cavity for making the cylinder block, and removing a solidified material of the light metal in the material holding section. A high quality cylinder block product can thus be obtained.

14 Claims, 4 Drawing Sheets

CYLINDER BLOCK MAKING METHOD AND DEVICE

This is a Continuation of application Ser. No. 07/467,194, filed Jan. 18, 1990, now abandoned.

BACKGROUND OF THE INVENTION

1. Field of the Invention

The present invention relates to a method and device for making a cylinder block of an engine for an automotive vehicle.

2. Description of the Prior Art

In making a cylinder block of an engine, it has been conventionally known that a plurality of cylinder liners are disposed adjacent to one another and casted together with a light metal, such as an aluminum alloy, to get a desirable sliding property of a cylinder bore against a piston, as disclosed in Japanese Patent Public Disclosure No. 62-77149, laid open to the public on Apr. 9, 1987.

Japanese Patent Public Disclosure No. 61-155645, laid open to the public in 1986, proposes to reduce the length of the cylinder block by bringing the cylinder liners close to one another in a longitudinal direction thereof. A plurality of cylinders are arranged within the cylinder block.

It should, however, be noted that a molten light metal material has difficulty in reaching an end portion of a cavity between the cylinder liners successfully as the distance between the cylinders is reduced. Specifically, if the cylinder liner is formed with a flange portion at the top end thereof for improving a seal property between the cylinder block and a cylinder head, the difficulty is remarkable, because the distance between the cylinder liners is further reduced at the top end thereof, which forms a dead end for the molten material in the cavity. This may result in a casting defect, such as a blow hole. This kind of defective cylinder block may induce a crack therein.

Additionally, since the distance between the cylinder liners in the vicinity of the flange portion thereof is smaller than in other portions, the cooling speed of the molten material around the flange portion is greater than at other portions in terms of heat capacity.

Such differences in the cooling speeds produces a residual internal stress. Consequently, the residual internal stress may induce a crack in the cylinder block.

SUMMARY OF THE INVENTION

It is, therefore, an object of the present invention to provide a method for making a cylinder block of a high quality.

It is another object of the present invention to provide a device for making a cylinder block of a high quality.

It is further object of the present invention to provide a method for making a cylinder block in which a molten casting material can be desirably introduced to anywhere in the cavity, even if a cylinder liner is formed with a flange portion.

It is still another object of the present invention to prevent defects in a casted cylinder block product, thus obtaining a high cylinder block product quality.

It is a further object of the invention to prevent the residual internal stress from being produced in the casted cylinder block product.

It is still further object of the present invention to prevent the crack from being produced in the cylinder block.

It is yet another object of the present invention to provide a relatively simple device and method for making the cylinder block.

The above and other objects of the present invention can be accomplished by a method for making a cylinder block including a plurality of cylinder liners with flange portions respectively arranged side by side so as to be extended in one direction. Each of the cylinder liners is casted together with a light metal to form a cylinder bore of an engine. The method comprises the steps of disposing the cylinder liners within a cavity in a side by side relationship with one another along the one direction, with each of the cylinder liners being held by core means for forming the cylinder bore, forming a material holding section above a gap defined by the flange portions of the two cylinder liners adjacent to each other to cover at least the narrowest portion of the gap so as to communicate the two cylinder liners with each other therethrough, introducing a molten material of the light metal into the cavity for making the cylinder block, and removing a solidified material of the light metal in the material holding section.

A device for making a cylinder block comprises core means disposed in the cavity to be engaged with the cylinder liner for forming cylinder bores corresponding thereto in a manner that the cylinder liners is arranged side by side with a predetermined distance for forming cylinder bores, and material holding means provided above a gap defined by the flange portions of two of the cylinder liners adjacent to each other for communicating the two adjacent cylinder liners with each other therethrough above the flange portion.

According to the present invention, the molten material is desirably supplied to any location in the cavity even to the top end portion of the cylinder liner, because of the material holding section provided between the adjacent cylinder liners to communicate them therethrough. The material holding section also effects an increase in the heat capacity around the top end portion or around the flange portion of the cylinder liners to equalize the cooling speed of the molten material in the cavity. Consequently, the residual internal stress can be suppressed.

The above and other features of the present invention will be apparent from the following description, making reference to the accompanying drawings.

DESCRIPTION OF THE PREFERRED EMBODIMENT

Figure 1:
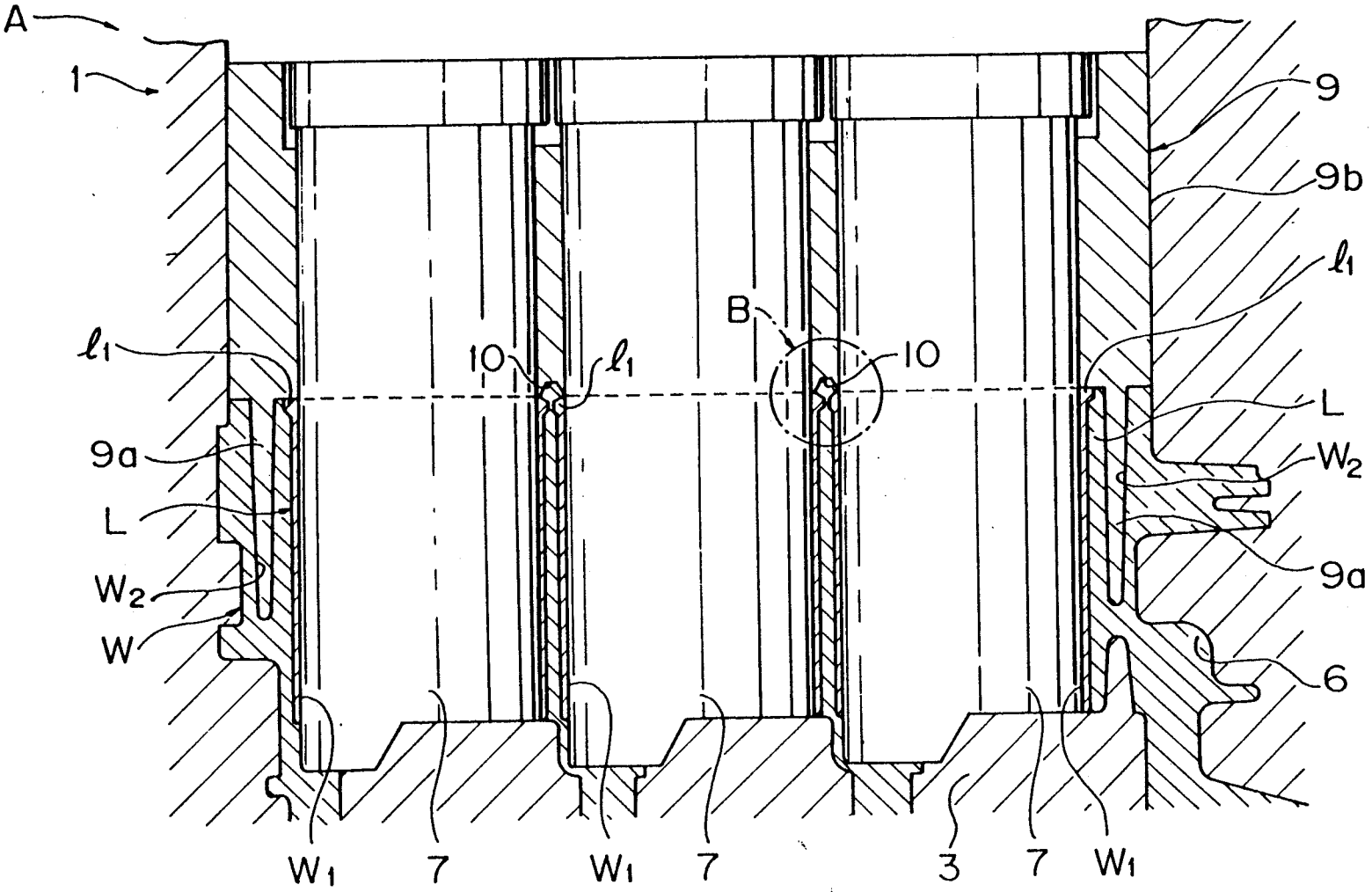
FIG. 1 is a partial and sectional view of an essential portion of a cylinder block making device in accordance with a preferred embodiment of the present invention.
Figure 2:
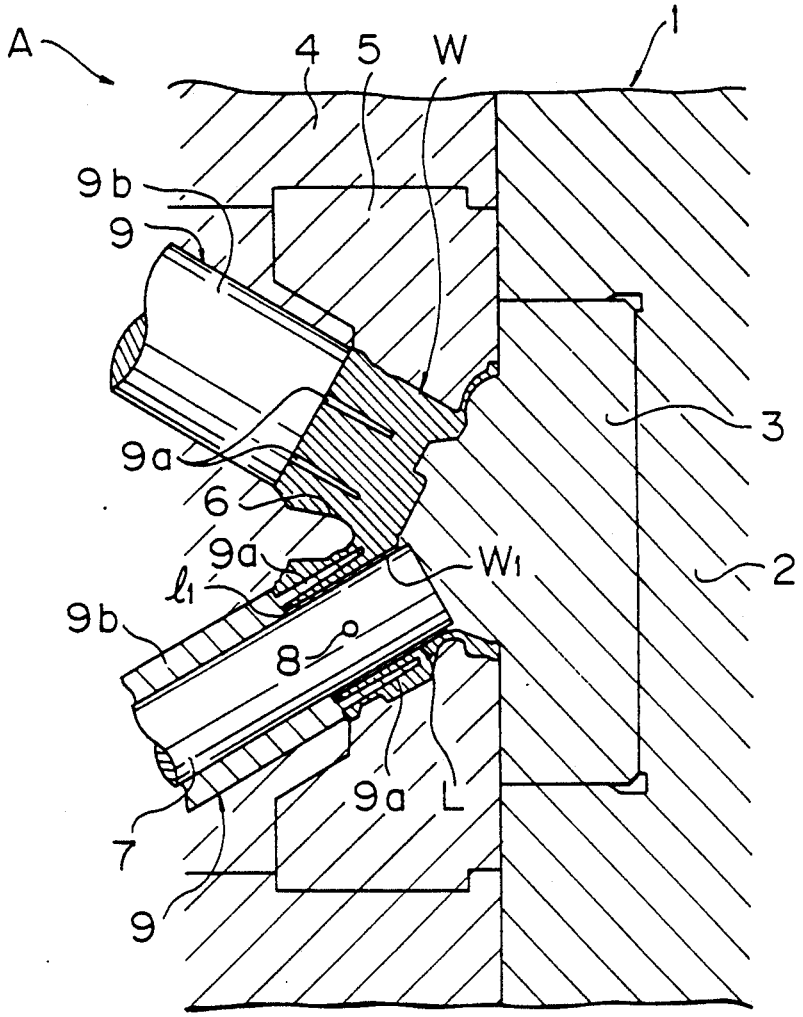
FIG. 2 is a partial and sectional view of an essential portion of the device of FIG. 1 but showing a different portion.
Figure 3:
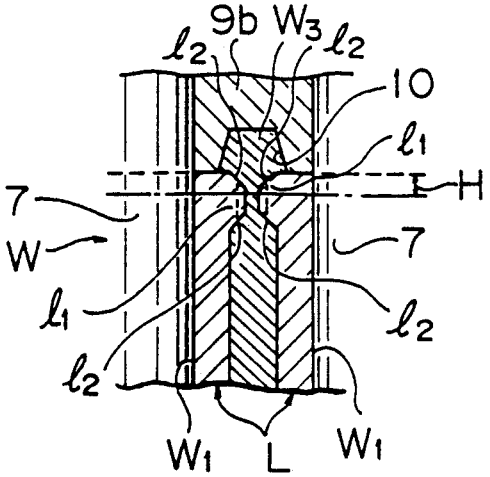
FIG. 3 is an enlarged view of a portion B of FIG. 1.
Figure 4:
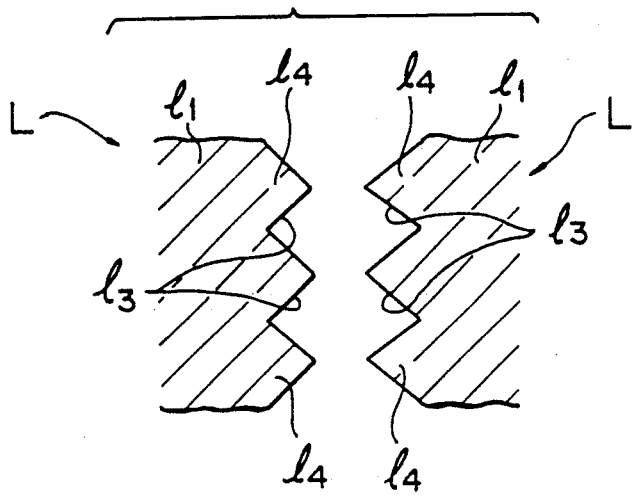
FIG. 4 is an enlarged sectional view of flange portions of cylinder liners adjacent to each other.

Referring to the drawings, and specifically to FIGS. 1 through 3, there is shown a cylinder block making device A for making a cylinder block W for a so called six-cylinder V type engine. The cylinder block W includes six cylinder liners L with flanges $l_1$ at one ends (upper ends) thereof respectively and arranged side by side. As shown in FIG. 1, the device A is provided with a metal mold 1 having a stationary mold 3 integrally secured to a holder 2, and a movable mold 5 integrally secured to a holder 4. When the stationary mold 3 and the movable mold 5 are engaged with each other, a cavity 6 is defined for casting the cylinder block W. Six cylindrical cores 7 are arranged in the cavity 6 for forming corresponding cylinder bores w1. The cores 7 are retractable from the cavity 6 by means of a hydraulic cylinder (not shown).

Each of the cores 7 is circumferentially provided with three balls 8 projected from an external surface thereof with the same distance therebetween and urged by a coil spring radially outwardly for holding the cylinder liner L against the core 7.

The movable mold 5 is provided with a pair of tubular mold members 9 for forming water jackets w2. Each of the tubular mold members 9 is provided with a main body portion 9*b* and a plurality of projections 9*a* projected from an end surface of the main body portion 9*b*. The tubular mold members 9 are mounted on the movable mold 5 so as to be retracted from the cavity 6 and to surround the core 7. When the projections 9*a* of the tubular mold member 9 are projected into the cavity 6 by means of the hydraulic cylinder device, the corresponding water jackets w2 are formed. The end surface of the main body portion 9*b* of the tubular mold member 9 is abutted against the flange $l_1$ of the cylinder liner L engaged with the outer surface of the core 7 to position the cylinder liner L.

Figure 5:
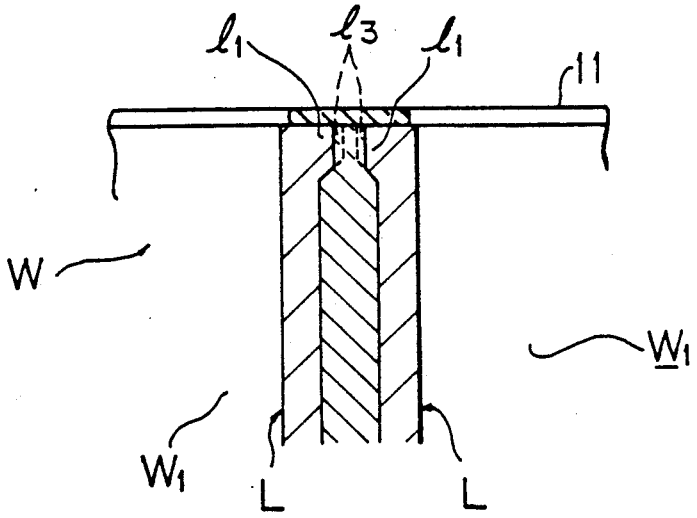
FIG. 5 is a sectional view showing top end portion of a cylinder block product of the present invention after removing a solidified metal portion in a material holding section.

As clearly shown in FIG. 3, the tubular mold member 9 is formed with a groove or molten material holding section 10 at the end portion so as to appear on the end surface thereof. The holding section 10 is positioned above a flange gap or space defined between the two flanges 11 of the adjacent cylinder liners L to cover at least the narrowest portion of the flange gap. The holding section 10 is communicated with the cavity 6 so that the holding section 10 constitutes a part of the cavity 6. The holding section 10 extends in a direction substantially perpendicular to a cylinder arrangement direction along which the cylinder bores w1 are arranged in a side by side relationship with one another. The holding section 10 is arranged to straddle the narrowest portion of the flange gap to communicate cavity portions of opposite sides of the narrowest portion of the flange gap as well as the narrowest portion. The thickness of the flange $l_1$ in molding step is greater than that in the final dimension of the product by a predetermined thickness H as shown in FIG. 3. This means that the flange $l_1$ is provided with a surplus portion of thickness H in the molding step. This surplus portion of the flange $l_1$ is removed together with a casted portion w3 in the holding section 10 after molding step. The flange $l_1$ of the cylinder liner L is of a truncated configuration. Namely, the flange $l_1$ of the cylinder liner L is provided with an upper and lower tapered surfaces $l_2$ as shown in FIG. 3. The tapered surface $l_2$ facilitates an introduction of the molten material into the holding section 10. Furthermore, the flange $l_1$ is formed with a serrated surface having bottoms 13 and crests 14 so as to improve a sealing property against a gasket 11 disposed between the cylinder block and cylinder head. The serration extends substantially in an up and down direction in FIGS. 3 and 5 or in a direction of an axis of the cylinder bore w1. The serrated surface of the flange $l_1$ of a cylinder liner L extends substantially in parallel with a serrated surface of an adjacent cylinder liner L. In this case, the crests 14 and the bottoms 13 of the flange $l_1$ of one of the cylinder liner L face the corresponding crests $l_4$ and bottoms $l_3$ of another flange $l_1$ of the adjacent cylinder liner L. Thus, a gap defined by adjacent bottoms $l_3$ is approximately three times a gap defined by adjacent crests 14 so that the molten material is facilitated to be introduced into the holding section 10.

In operation, the cylindrical cores 7 and the tubular mold members 9 are projected into the cavity by means of the hydraulic cylinder device in an open condition of, the metal mold 1. Then, the cylinder liner L with the flange $l_1$ is brought into engagement with the outer surface of the core 7 with the flange $l_1$ being abutted against the end surface of the main body portion 9*b* of the mold member 9. The balls 8 urge against the inner surface of the cylinder liner L in a radial direction by means of the coil spring to hold the cylinder liner L on the core 7.

Then, the metal mold 1 is closed so that the cylinder liners L are arranged within the cavity 6 side by side. The molten material of a light metal including an aluminum alloy is introduced into the cavity 6 to cast the cylinder block W. Since the material holding section 10 is provided above the space between the flanges $l_1$ the molten material introduced into the cavity 6 can be quickly and properly led to the space through the holding section 10 and the space between the bottoms $l_3$ of the serration. Thus, a defect or blemish such as blow hole of the product can be prevented from being produced. The heat capacity is increased in the vicinity of the space between the flanges $l_1$ in terms of the holding section 10 so that a tension stress acting on a thin portion in the space between the flanges $l_1$ can be reduced as low as possible as the molten material of a relatively thick portion is cooled down around the thin portion between the flanges $l_1$. In addition, the casted portion or solidified material w3 in the holding section 10 effects to reinforce the thin portion between the flanges $l_1$ so that the tension stress acting on the thin portion is weakened.

Figure 6:
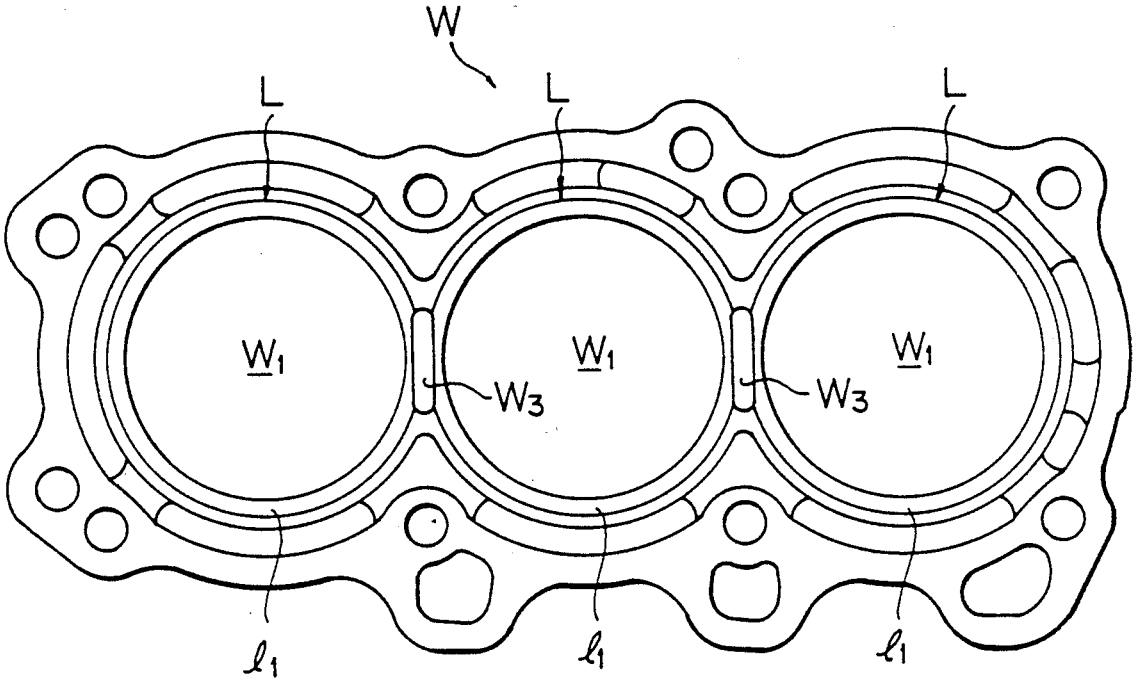
FIG. 6 is a plan view of a top end of the cylinder block product before removing the solidified metal portion in the material holding section.

Thereafter, the metal mold is opened and the cylindrical cores 7 and tubular mold members 9 are retracted from the cylinder bores w1 and the water jackets w2 by means of the hydraulic cylinder. At this stage, the solidified metal materials w3 in the holding sections 10 are attached to the casted cylinder block product W as shown in FIG. 6.

Then, a top portion of the flange $l_1$ is removed by the thickness H together with the solidified material w3 to get a final product of the light metal cylinder block W with the cylinder liners L being arranged side by side.

This can be accomplished by merely forming the material holding section 10 at the end portion of the tubular mold members 9 without necessitating any drastic modification of the cylinder block making device.

Figure 7:
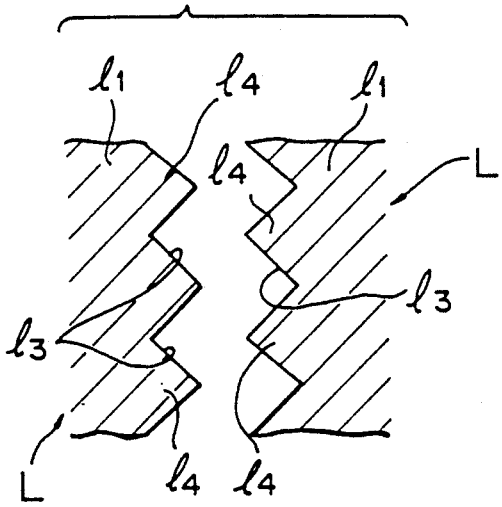
FIG. 7 is an enlarged sectional view similar to FIG. 4 but showing another embodiment.

In another embodiment, the serration of the flange $l_1$ can be constituted in a manner that the crests 14 face the bottoms $l_3$ respectively as shown in FIG. 7 unlike FIG.

4. In this case, a distance between the flanges $l_1$ of the adjacent cylinder liners L is twice as wide as that in case of no serration on the flange $l_1$. The bottom 13 can take another configuration such as round, trapezoid and the like.

The present invention can be applied for not only six-cylinder V type engine but also another type of engine such as four-cylinder type.

It will be apparent that various modifications and improvements may be made based on the above descriptions by those skilled in the art without departing from the scope and spirit of the claims.

We claim:

1. A method for making a cylinder block, comprising the steps of:

providing a plurality of cylinder liners with flange portions, holding each of the cylinder liners by core means, arranging said cylinder liners in a side by side relationship relative to one another so as to extend in one direction, disposing the cylinder liners within a mold cavity in said side by side relationship relative to one another along said one direction, forming a cylinder bore by said core means and a material holding section above a gap defined by the flange portions of two adjacent cylinder liners, said gap having narrower and wider portions, said material holding section covering at least the narrower portion of the gap and communicating the two adjacent cylinder liners with each other therethrough, introducing a molten light metal material into the mold cavity for making the cylinder block, and removing solidified light metal material in the material holding section, together with a surplus portion of said flange portion, from the rest of the cylinder block so as to form, from said flange portion, a top surface of said cylinder block.

2. A method as recited in claim 1, wherein each cylinder liner is resiliently held by a core means.

3. A method as recited in claim 2, wherein each core means is provided with ball means, arranged in circumferentially spaced relationship relative to each other, for resiliently retaining the cylinder liner on each core means.

4. A method as recited in claim 1, wherein a predetermined thickness of a top portion of each flange portion is removed, together with the solidified material in the material holding section.

5. A device for making a cylinder block including a plurality of cylinder liners with flange portions, arranged side by side, extending in one direction, each of the cylinder liners being casted together with alight metal to form cylinder bores of an engine, comprising:

core means disposed in a mold cavity for engaging each of the cylinder liners, said core means forming cylinder bores corresponding thereto, arranged side by side, with a predetermined distance between adjacent cylinder bores, material holding means provided above a gap defined by the flange portions of two adjacent cylinder liners, said gap having narrower and wider portions, said material holding means covering at least the narrower portion of said gap and communicating the two adjacent cylinder liners with each other therethrough, above the flange portions of the two adjacent cylinder liners, and tubular mold means for forming a water jacket, the material holding means including a section formed in the tubular mold means.

6. A device as recited in claim 5, wherein the material holding means includes a section which extends in a direction substantially perpendicular to a longitudinal direction of said cylinder block.

7. A device as recited in claim 5, wherein the material holding means includes a section which straddles the narrower portion of the gap defined by the flange portions of the two adjacent cylinder liners so as to communicate cavity portions of opposite sides of the narrower portion.

8. A device as recited in claim 7, wherein the section of the material holding means covers at least the narrower portion of the gap.

9. A device as recited in claim 5, wherein the flange portion of each cylinder liner is formed with upper and lower tapered surfaces.

10. A device as recited in claim 5, wherein each flange portion is formed with a serrated surface including plural bottoms and crests, the serrated surface of the flange portion of one cylinder liner facing the serrated surface of the flange portion of another cylinder liner adjacent to said one cylinder liner, each of the plural bottoms of said one cylinder liner facing each of the plural bottoms of said another cylinder liner.

11. A device as recited in claim 5, wherein each flange portion is formed with a serrated surface including plural bottoms and crests, the serrated surface of the flange portion of one cylinder liner facing the serrated surface of the flange portion of another cylinder liner adjacent to said one cylinder liner, each of the bottoms of said one cylinder liner facing each of the crests of said another cylinder liner.

12. A device as recited in claim 10, wherein the serrated surface extends substantially in a direction of an axis of a cylinder bore.

13. A device as recited in claim 5 and further comprising a stationary mold and a movable mold, the core means and the tubular mold means being mounted on the movable mold in a manner such that the core means and the tubular mold means are retractable from the mold cavity.

14. A device as recited in claim 5, wherein the tubular mold means comprises a main body portion and a plurality of extensions projected from an end surface of the main body portion, the end surface of the main body portion abutting against the cylinder liners for positioning the cylinder liners, said section being formed so as to appear on the end surface of the main body portion.

* * * * *